US007293933B1

(12) United States Patent
Baldwin

(10) Patent No.: US 7,293,933 B1
(45) Date of Patent: Nov. 13, 2007

(54) REMOVABLE DIVIDER CONSTRUCTION FOR COIL BOUND NOTEBOOKS

(75) Inventor: Judith Moncrieff Baldwin, New York, NY (US)

(73) Assignee: Strategic Financial Communications Corp., New York, NY (US)

( * ) Notice: Subject to any disclaimer, the term of this patent is extended or adjusted under 35 U.S.C. 154(b) by 174 days.

(21) Appl. No.: 10/922,506

(22) Filed: Aug. 20, 2004

(51) Int. Cl.
*B42F 13/00* (2006.01)

(52) U.S. Cl. ..... 402/79; 402/73

(58) Field of Classification Search ..... 402/57, 402/58, 73, 79, 502; D19/26, 27, 33
See application file for complete search history.

(56) References Cited

U.S. PATENT DOCUMENTS

| | | | | |
|---|---|---|---|---|
| 818,130 | A * | 4/1906 | Swan | 402/79 |
| 2,848,163 | A | 8/1958 | Van Horne Serrell | |
| 2,904,900 | A | 9/1959 | Kramer | |
| 3,719,161 | A * | 3/1973 | Wegner | 116/240 |
| 4,193,704 | A | 3/1980 | Miller et al. | |
| 4,430,015 | A | 2/1984 | Nerlinger | |
| 4,699,538 | A | 10/1987 | Caine | |
| 4,907,905 | A | 3/1990 | Fournier | |
| 5,015,114 | A | 5/1991 | Miller | |
| D319,260 | S | 8/1991 | Dubaj | |
| 5,433,546 | A * | 7/1995 | Kershaw | 402/79 |
| 5,572,815 | A * | 11/1996 | Kovner | 40/404 |
| 5,590,972 | A * | 1/1997 | Shobin | 402/79 |
| 5,888,011 | A * | 3/1999 | Reinbold, Jr. | 402/70 |
| 6,672,785 | B1 | 1/2004 | O'Hara et al. | |

* cited by examiner

*Primary Examiner*—Dana Ross
(74) *Attorney, Agent, or Firm*—Schweitzer Cornman Gross & Bondell LLP

(57) ABSTRACT

A divider element formed of a sheet member adapted to be removably coupled to a binding element of a coil bound notebook. The divider element includes a plurality of preferably T-shaped connector elements defining a narrow cut region and coil receiving aperture therebetween. Coil portions of a binding element may pass through the cut region into and out of the coil receiving aperture. The divider element is formed of a deformable material such the connector elements are adapted to be flexed out of the plane of the sheet member without substantial bending or breakage of the connector elements. The divider element may engage the coil portions of a binding element without significant manipulation of the connector elements by way of selectively urging the coil portions of a bound notebook in a direction parallel to the binding element axis.

5 Claims, 3 Drawing Sheets

REMOVABLE DIVIDER CONSTRUCTION FOR COIL BOUND NOTEBOOKS

FIELD OF THE INVENTION

The invention relates generally to the field of coil bound notebook accessories and, in particular, to a divider element which may be removably coupled, as desired, to coils of a notebook or similar coil bound article.

BACKGROUND OF THE INVENTION

Coil bound notebooks, including writing notebooks, organizers, calendars, planners, etc., are well known. Notebooks of this type commonly include at least one divider to partition or separate various sections thereof to facilitate location of a desired section or page. Generally, however, such dividers are non-removably placed in predetermined locations by the manufacturers such that the users can neither select the most suitable location for the placement of dividers nor remove and reinsert divider elements as desired.

One approach to remedying the disadvantages associated with conventional coil bound notebooks having dividers is disclosed in U.S. Pat. No. 6,672,785 issued to O'Hara et al., wherein an insert is disclosed comprising a sheet of material having a plurality of wing-like tabs extending therefrom which are adapted to removably engage predetermined regions of a coil binding element. Because of the configuration of the wing-like tabs, however, significant manipulation of the tabs and corresponding coil elements is required in order to couple the divider to the binding element. Thus, the wing-like tabs are more likely to break apart from the sheet and render the divider useless for its intended purpose. In addition, the embodiments disclosed by O'Hara et al. are not adapted to engage substantially the entirety of the coils of a binding element.

Therefore, a need still exists for a divider element adapted to removably couple to a coil bound notebook without undue stress being exerted on the connector elements. Further, a need exists for a removable divider element of simple construction for facilitated engagement and disengagement with a coil binding element.

Accordingly, it is an object of the present invention to provide a divider element adapted to removably couple to substantially the entirety of the coil portions of a binding element.

It is a further object of the present invention to provide a divider element construction wherein less stress is exerted on the individual connector elements during insertion and removal, reducing the likelihood of breakage.

Another object of the present invention is to provide a divider element of simple construction and economical manufacture.

A still further object of the present invention is to provide a divider element construction adapted to removably couple to almost any coil binding element.

SUMMARY OF THE INVENTION

In accordance with the foregoing objects and advantages, the present invention is directed to a new and improved removable divider element. Divider elements in accordance with the invention may be removably bound to a variety of coil bound notebook constructions by way of a plurality of connector elements disposed along a binding edge thereof. Each connector element comprises a stem and transversely extending shoulder portion such that the connector elements are substantially T-shaped. The stem and shoulder portions of two adjacent connector elements define a narrow cut region and coil receiving aperture therebetween, wherein the cut region is adapted to permit a corresponding coil portion to pass therethrough either into or out of the coil receiving aperture.

The divider element is formed of a deformable, preferably vinyl material, so as to permit a corresponding coil portion to pass intermediate two adjacent shoulder portions, i.e., through the cut region, without undue stress being exerted on the connector elements. Advantageously, the construction of the divider element permits the user to substantially manipulate the coil portions of binding elements to further enhance the ease in which the divider element may be coupled to a binding element and, therefore, reduce the force that must be applied to the connector elements during engagement and disengagement.

BRIEF DESCRIPTION OF THE DRAWINGS

For a more complete understanding of the above and other features of the invention, reference shall be made to the following detailed description of the preferred embodiments of the invention wherein.

DETAILED DESCRIPTION OF A PREFERRED EMBODIMENT

Figure 1:
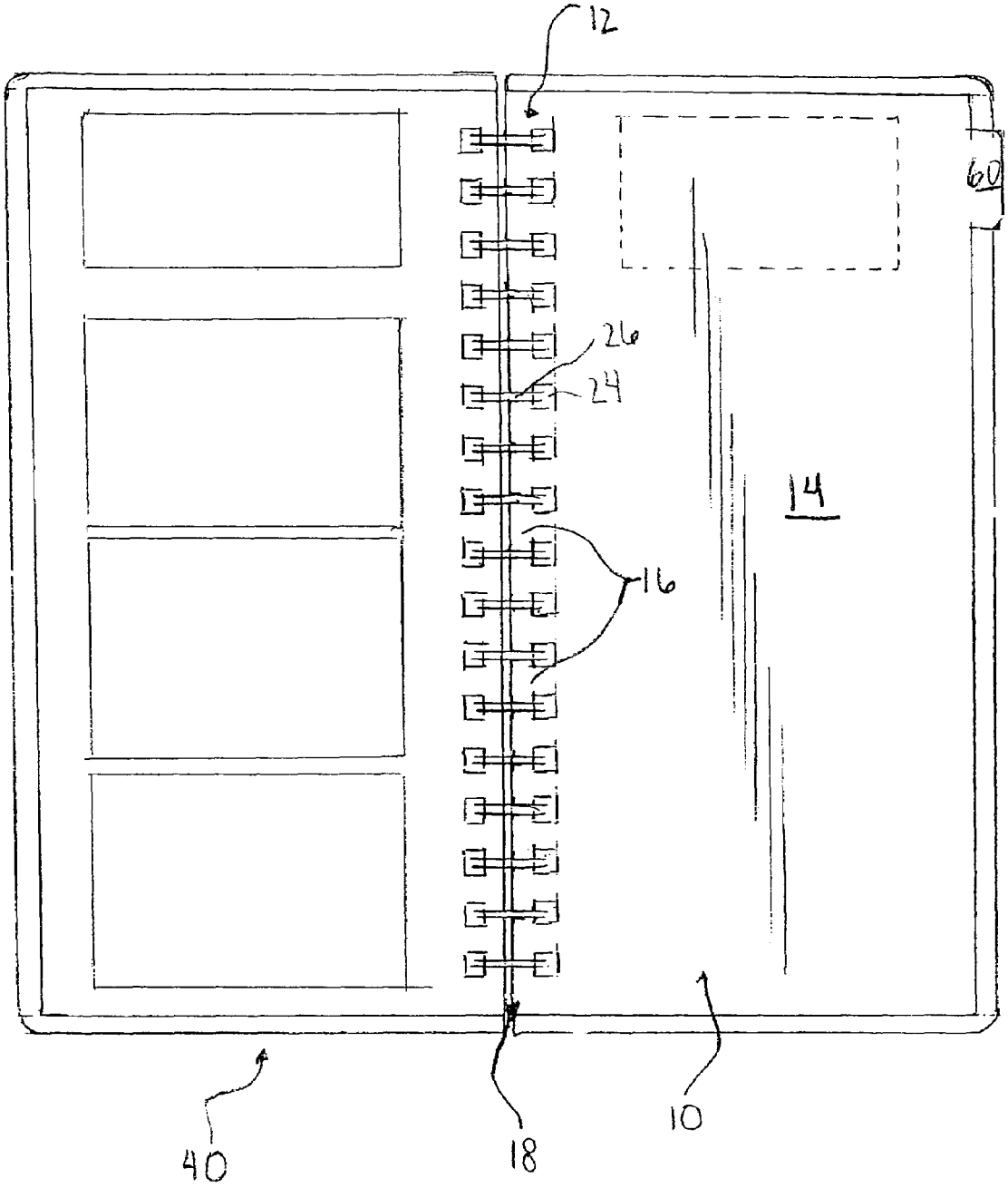
FIG. 1 is a plan view of a coil bound notebook having a removable divider in accordance with the invention.

Referring now to the drawings, the selectively changeable, removable divider element construction of the invention is indicated generally by reference numeral 10. The divider element 10 is adapted to be removably coupled to a coil binding element 12 of a bound notebook 40 as shown, for example, in FIGS. 1 and 3 and described in detail below. In particular, the divider element 10 of the invention is comprised of a generally rectangular sheet member 14 having a plurality of connector elements 16 extending from a binding edge thereof 18.

Figure 2:
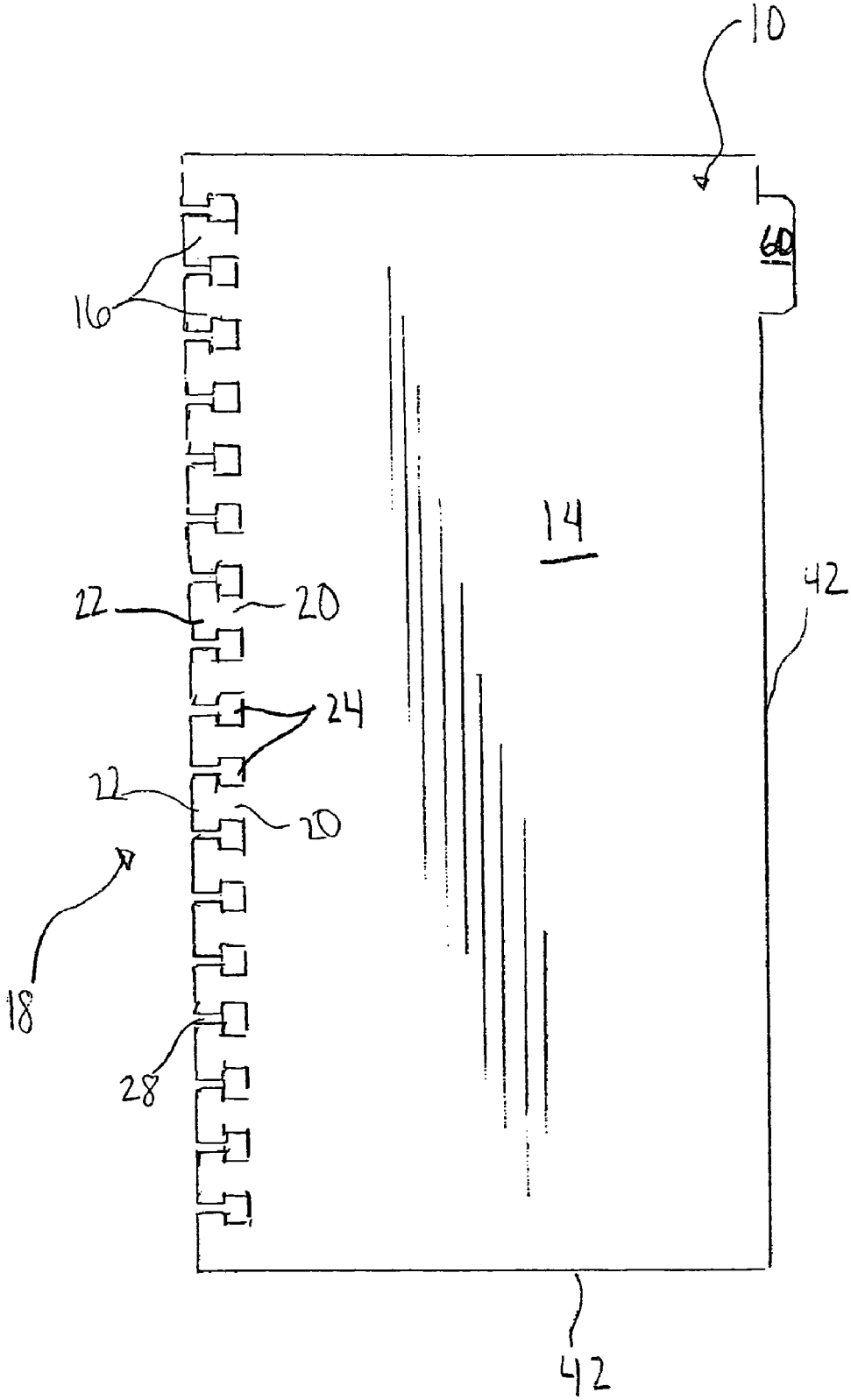
FIG. 2 is a plan view of a removable divider in accordance with the invention.
Figure 3:
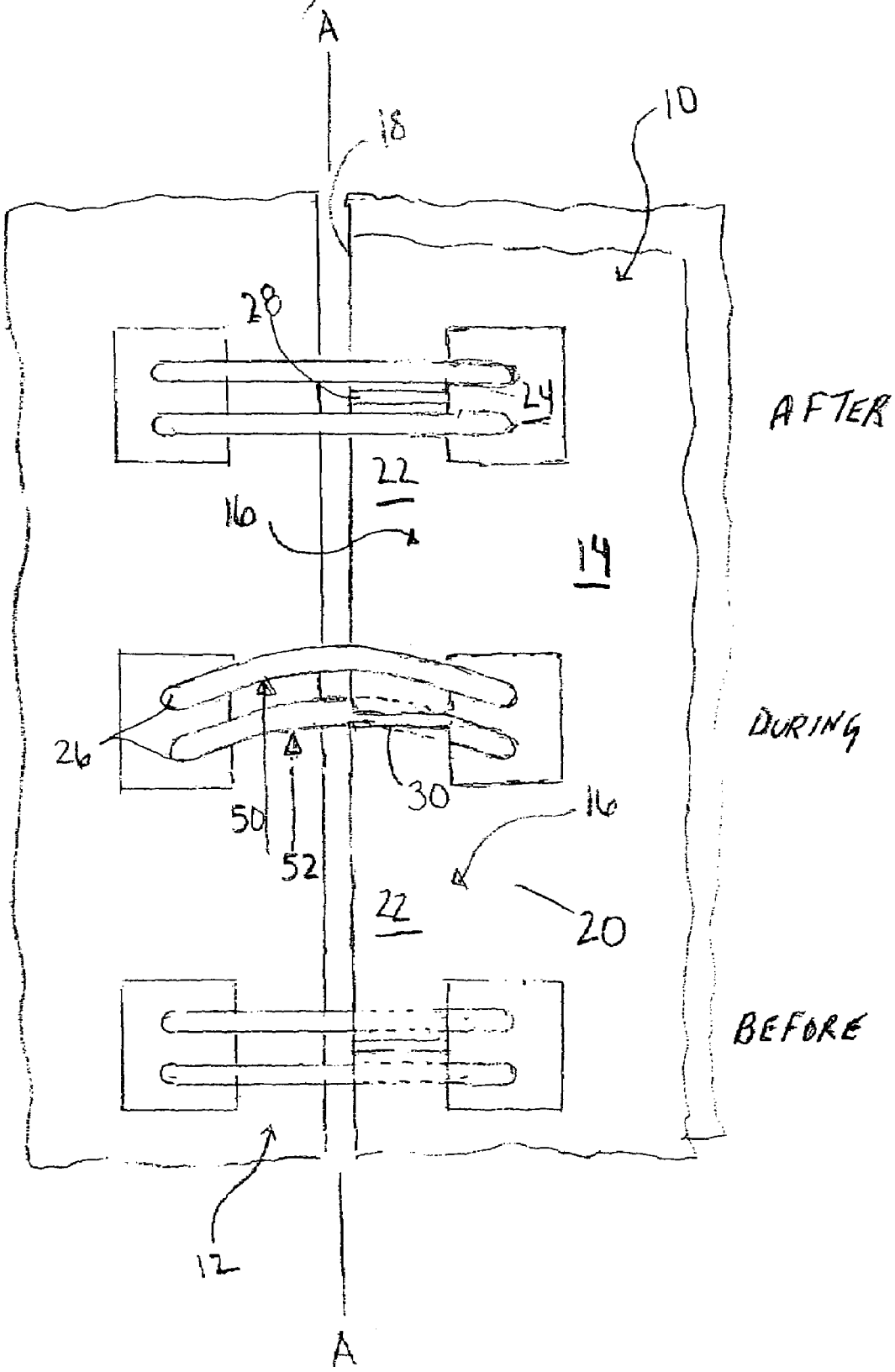
FIG. 3 is an enlarged, fragmentary view of the removable divider as shown in FIG. 1.

With particular reference to FIG. 2, it can be seen that each connector element includes a stem 20 which terminates in a transversely extending shoulder portion 22 such that each stem 20 and shoulder portion 22 of two adjacent connector elements 16 defines a coil receiving aperture 24 therebetween. Each coil receiving aperture 24 is disposed in spaced apart relationship and dimensioned to receive a corresponding coil portion 26 of a coil bound notebook 40. As shown in FIGS. 1 and 3, each coil portion 26 may be formed of a pair of wire coils individually connected to the pages of a notebook 40. Alternatively, the coil portions 26 may be formed of more or less than two wires individually connected to notebook pages or interconnected such as, for example, is common to helical coil binding elements, whereby the coil receiving aperture 24 is dimensioned accordingly.

The coil portions 26 may be selectively inserted into and removed from corresponding coil receiving apertures 24 by way of a cut region 28 between each shoulder portion 22 which extends into the coil receiving aperture 24. As shown in FIGS. 2 and 3, the cut region 28 may be a portion of the sheet member 14 cut-away, i.e., wherein a portion of the material is removed from the sheet member 14, or by way of a slit cut into the sheet member 14 at the midpoint of each coil receiving aperture 24. In either construction, it is preferred that the width of the cut region 28 is less than the width of the corresponding coil portion 26 so as to securely maintain the coil portion 26 within its corresponding aperture 24 upon placement therein.

In order to insert a coil portion 26 into the narrow cut region 28 of the divider element 10, it is preferred that at least the connector elements 16 are formed of a somewhat flexible, deformable material, such as vinyl, as will be detailed hereafter. In a preferred embodiment of the invention, the entirety of the divider element 10 is of the same flexible material providing for a simplified construction of economical manufacture. In this manner, the entire divider element 10 may be manipulated as necessary.

In use, the desired location for placement of the divider element 10 is selected by the user. Because of the deformable nature of the divider element 10 and generally flexible nature of coil binding elements 12, the divider element 10 may be coupled to a coil binding element 12 in a variety of manners. In instances where the coil binding element 12 of a notebook is easily manipulated, it is preferred that the user urge the coil portions 26 as necessary to insert the divider element 10, as opposed to extensive manipulation of the connector elements 16 such that the connector elements 16 are less prone to breakage.

For example, as shown in FIG. 3, to couple the divider element 10 to the coil portions 26 of a binding element 12, the coil portions 26 may be individually inserted within a corresponding coil receiving aperture 24. With particular reference to arrows 50 and 52 in FIG. 3, to insert a coil portion 26 between two adjacent connector elements 16, the selected coil portion 26 of a movable binding element 12 may be urged in a direction parallel to Axis A, i.e., away from an edge 30 of the adjacent shoulder portion 22, such that minimal force may then be exerted downwardly on the adjacent edge 30 to at least partially engage the shoulder portion 22 with the coil portion 26, as shown in the "DURING" and "AFTER" depictions of FIG. 3.

This process of selectively moving a coil portion 26 in a parallel direction in relation to Axis A, so as to enable facilitated engagement of adjacent connector elements 16 and corresponding coil portions 26, is repeated with each connector element 16 until each of the coil portions 26 are inserted within a corresponding coil receiving aperture 24. By selectively urging the coil portions 26, only minimal force is required to be exerted on connector elements 16. It should be understood that to disengage the divider element 10, the coil portions 26 may be manipulated in the same manner as described above, whereby minimal force is then exerted upwardly adjacent connector elements 16.

Alternatively, the divider element 10 of the invention may also be used in connection with notebooks having fixed or immovable coil portions 26. Because of the preferred flexible nature of the connector elements 16, each connector element 16 is adapted to be flexed out of the plane of the sheet member 14 so as to widen the cut region 28, i.e., forming an opening, between to adjacent connector elements 16 when one of two adjacent connector elements 16 is flexed out of the plane of the sheet member 14. The connector element 16 may be flexed until there is attained an opening of sufficient size to permit a corresponding coil portion 26 to pass intermediate the two adjacent connector element shoulder portions 22 through the cut region 28. The coil portion 26 may then be urged therethrough into the coil receiving aperture 24.

Advantageously, once the coil portion 26 has been passed through the cut region 28 either into or away from the receiving aperture 24, the deformable nature of the connector elements 16 permits the connector elements 26 to readily revert back into the previous coplanar position relative to the sheet member 14.

The same method of manipulating one of two adjacent connector elements 16 as described above is repeated until each coil portion 26 is inserted into (or removed from) the corresponding receiving aperture 24 as desired. As should be apparent to one skilled in the art, the specific embodiments of the connector elements 16 depicted and described herein provide for a divider element 10 which may be easily manipulated for coupling to or removal from a coil binding element 12. In addition, the divider element 10 is adapted for secure retention to a coil binding element 12 sufficient to withstand ordinary handling without disengaging when the connector elements 16 are in an unflexed position, i.e. lying in the same plane as the sheet member 14.

While the divider element 10 construction of the invention has been shown and described in accordance with preferred embodiments thereof, it is understood that various modifications may be made thereto without departing from the spirit and scope of the invention. For example, individual divider elements may include one or more tab portions 60 extending from an outer edge 42, i.e., an edge without connector elements 16, for facilitated location of a divider element 10 coupled to a coil bound notebook 14, as shown, for example, in FIG. 1.

In addition, while the binding edge 18 has been depicted in the drawings as being along a longitudinally extending edge of the sheet member 14, the connector elements 16 and associated coil receiving apertures 24 may be adjacently disposed along any edge of a divider element 10 so as to accommodate notebooks having a coil binding element 12 disposed adjacent an upper edge or otherwise. Similarly, the coil portions 26 may be formed of any suitable wire or plastic material, in any desirable configuration, including circular, square, helical, etc. Accordingly, the invention should be defined by the appended claims.

What is claimed is:

1. A coil bound notebook system comprising;

a coil binding element formed of a flexible, wire-like material having a plurality of coil portions for engaging pages of a notebook;

a divider element having a sheet member, said sheet member having a plurality of adjacently disposed, substantially T-shaped connector elements disposed along a binding edge of said sheet member, each said connector element having a stem which terminates in a transversely extending shoulder portion, each said stem and shoulder portion of two adjacent connector elements defining a coil receiving aperture therebetween, wherein said coil receiving aperture is dimensioned to receive a corresponding coil portion of said coil binding element, each said shoulder portion of two adjacent connector elements further defining a cut region therebetween, said cut region extending into said coil receiving aperture, each said cut region having a width between two adjacent connector element shoulder portions that is less than the width of said corresponding coil portion when said two adjacent connector elements are in an unflexed position, in the same plane of said sheet member, providing for the secure retention of said coil portion within said coil receiving aperture, at least the portion of said divider element comprising said connector elements being constructed of a flexibly deflectable material, whereby each said connector element may be deflected out of a plane of said sheet material so as to enable facilitated passage of a corresponding coil portion between two adjacent shoulder portions and through said cut region; and said coil binding element having an axis extending parallel to said binding edge and having flexible coil portions upper portions of which may be temporarily flexed in the direction of said axis to minimize the force and deflection required to be exerted on the connector elements during said facilitated passage of a coil portion between adjacent shoulder portions.

2. The notebook system of claim 1, wherein said flexibly deflectable material is vinyl.

3. The notebook system of claim 2, wherein said divider element is formed substantially entirely of said flexibly deflectable vinyl material.

4. The notebook system of claim 1, wherein said coil binding element is comprised of a plurality of pairs of coil portions, and said coil receiving apertures are sized and arranged to receive both of the coil portions of a pair thereof.

5. The notebook system of claim 1, wherein (a) said shoulder portions of said connector elements being so formed as to define edges extending generally parallel to said axis for engaging and retaining said coil portions.

* * * * *